United States Patent [19]

Hatayama et al.

[11] 4,366,414

[45] Dec. 28, 1982

[54] ELECTRODE OF COLOR PICTURE TUBE ELECTRON GUN AND METHOD FOR MANUFACTURE THEREOF

[75] Inventors: Shigeharu Hatayama, Mobara; Masaaki Yamauchi, Togane; Mamoru Ikeda, Mobara, all of Japan

[73] Assignee: Hitachi, Ltd., Tokyo, Japan

[21] Appl. No.: 148,038

[22] Filed: May 5, 1980

[30] Foreign Application Priority Data

May 18, 1979 [JP] Japan ..... 54-60410

[51] Int. Cl.[3] ..... H01J 29/46; H01J 9/02

[52] U.S. Cl. ..... 313/409; 29/25.17; 313/458; 313/460

[58] Field of Search ..... 29/25.14, 25.17; 313/326, 409, 411, 414, 447, 458, 460

[56] References Cited

U.S. PATENT DOCUMENTS 3,866,081 2/1975 Hasker et al. ..... 313/458 X
4,242,613 12/1980 Brambring et al. ..... 313/458 X
4,272,700 6/1981 Collins ..... 313/458

FOREIGN PATENT DOCUMENTS 1421865 1/1976 United Kingdom .

OTHER PUBLICATIONS

30AX Self-Aligning 110° In Line Color TV Display, IEEE Spring Conference, Jun. 1978, presented by Philips.

*Primary Examiner*—Paul L. Gensler
*Attorney, Agent, or Firm*—Antonelli, Terry and Wands

[57] ABSTRACT

A first grid electrode for an in-line type color picture tube electron gun and a method for fabrication thereof are disclosed. This electrode is formed of a single metal plate, and has a first recess having a predetermined width and depth formed in one surface of the metal plate and extending in the same direction as a direction in which a plurality of cathodes of the electron gun are arranged, and a second recess having a predetermined width and depth formed in the other surface of the metal plate and extending in the direction perpendicular to the extending direction of the first recess.

8 Claims, 25 Drawing Figures

ELECTRODE OF COLOR PICTURE TUBE ELECTRON GUN AND METHOD FOR MANUFACTURE THEREOF

The present invention relates to an electrode of an electron gun of a color television picture tube, or more in particular to a non-rotationally symmetrical first grid electrode having a cross slit and to a method for manufacture thereof.

The prior art and the present invention, and advantages of the latter will be described with reference to the accompanying drawings, in which:

FIGS. 3A and 3B show an example of the first grid electrode, in which FIG. 3A is a plan view thereof and FIG. 3B is a sectional view taken in line IIIB—IIIB in FIG. 3A;

FIGS. 5A and 5B are diagrams showing another example of the first grid electrode for explaining embodiments of the present invention, in which FIG. 5A is a plan view thereof and FIG. 5B is a sectional view taken in line VB—VB in FIG. 5A;

FIGS. 6A and 6B are diagrams showing a first embodiment of the first grid electrode according to the present invention, in which FIG. 6A is a plan view thereof, and FIG. 6B a sectional view taken in line VIB—VIB in FIG. 6A;

FIGS. 7A and 7B show a second embodiment of the first grid electrode according to the present invention, in which FIG. 7A is a plan view thereof and FIG. 7B is a sectional view taken in line VIIB—VIIB in FIG. 7A;

FIGS. 8A and 8B are diagrams showing a third embodiment of the first grid electrode according to the present invention, in which FIG. 8A is a plan view thereof and FIG. 8B is a sectional view taken in line VIIIB—VIIIB in FIG. 8A;

FIGS. 9A to 9F are diagrams for explaining a method for producing the electrode shown in FIGS. 8A and 8B, in which FIGS. 9A, 9C and 9E are plan views thereof in respective processes of fabrication, and FIGS. 9B, 9D and 9F are sectional views taken in lines IXB—IXB, IXD—IXD and IXF—IXF in FIGS. 9A, 9C and 9E respectively;

Figure 8A:
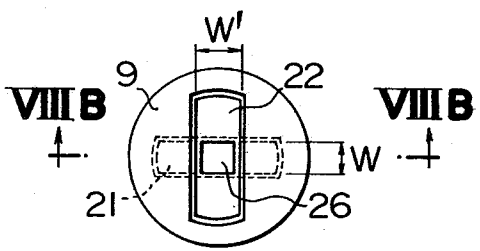
Figure 8B:
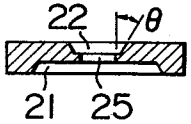
Figure 11:
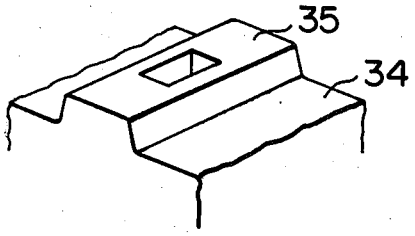
Figure 12A:
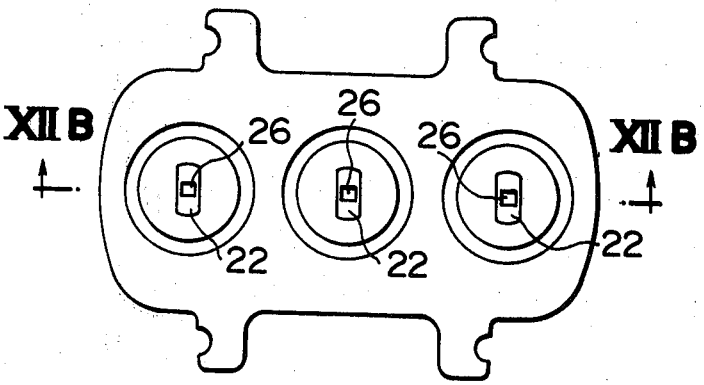
Figure 12B:
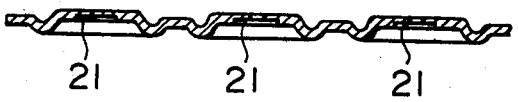

FIG. 11 is a perspective view of a die used for forming an electron beam pass hole in the fabrication of the electrode shown in FIGS. 8A and 8B; and FIGS. 12A and 12B are diagrams showing an example of the first grid electrode for an integrated electron gun according to the present invention, in which FIG. 12A is a plan view thereof, and FIG. 12B is a sectional view taken in line XIIB—XIIB in FIG. 12A.

Figure 1:
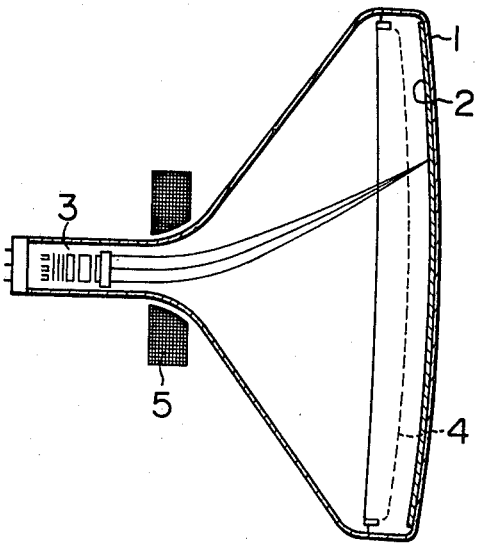
FIG. 1 is a sectional view of a color television picture tube.

Referring to FIG. 1, a color picture tube 1 comprises a phosphor screen 2 including a plurality of phosphor elements corresponding to the three primary colors and an electron gun 3 arranged within the neck portion of the tube. The electron gun 3 emits three electron beams corresponding to the three primary colors, which electron beams pass through a plurality of apertures in a color selective electrode 4 and impinge on the phosphor screen 2. The electron beams emitted from the electron gun 3 are deflected by a deflection magnetic field formed by a deflection coil 5 and scan the surface of the phosphor screen 2. As a result of the electron beams impinging on the phosphor screen 2, a picture image is reproduced.

Figure 2:
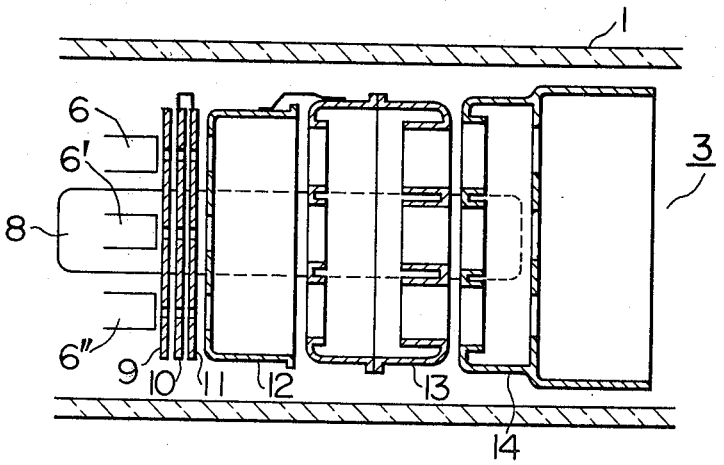
FIG. 2 is a sectional view of an electron gun arranged within the neck portion of the color television picture tube.

In FIG. 2, the electron gun 3 includes cathodes 6, 6', 6'', a first grid electrode 9, second grid electrodes 10 and 11, third electrodes 12 and 13, and fourth electrode 14. These electrodes are held by bead glasses 8 and arranged along a line which is substantially perpendicular to the phosphor screen 2. An integrated electron gun in which three electron guns for emitting three electron beams corresponding to the three primary colors are integrally formed is shown in the drawing. This integrated electron gun may be replaced with equal effect by three separate electron guns for emitting electron beams separately. In operation, the first grid electrode 9 is normally maintained at zero potential, and the second grid electrodes 10 and 11 are maintained at the potential of 600 to 700 volts and supplied with an accelerating voltage. The third grid electrodes 12 and 13 and the fourth grid electrode 14 constitute a main electronic lens. The electron gun shown in the drawing is what is called an in-line electron gun, in which the cathodes 6, 6' and 6'' are aligned substantially in parallel to the phosphor screen 2, and the first grid electrode 9 has respective beam pass apertures arranged in the same direction as the direction of alignment of the cathodes in positions corresponding thereto. In the description below, the direction of alignment of the cathodes will be referred to as the lateral direction and the direction perpendicular thereto as the vertical direction.

In an in-line color picture tube, the deflection magnetic field for deflecting the electron beams emitted from the electron gun is subjected to pincushion distortion and barrel distortion in order to attain self convergence. As a result, each electron beam is distorted as it passes through the deflection magnetic field, so that at the peripheral parts, especially, at the corners of the phosphor screen 2, the electron beam impinging on the phosphor screen is accompanied by a halo in the vertical direction due to its overfocus in that direction, thus reducing the resolution of the reproduced image. If the focus voltage is adjusted in an attempt to improve the focus characteristic (or the resolution of the reproduced image under the influence of the halo) at the peripheral parts of the phosphor screen, the focus characteristic at the central part of the fluorescent screen becomes deteriorated, thereby reducing the focus characteristic on the phosphor screen as a whole.

Figure 4A:
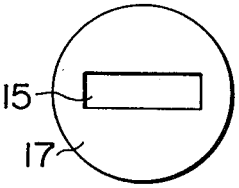
FIG. 4A PRIOR ART
FIGS. 4A and 4B are plan views of constituent members of the electrode shown in FIGS. 3A and 3B.
Figure 4B:
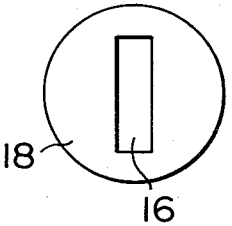
FIG. 4B PRIOR ART
Figure 3A:
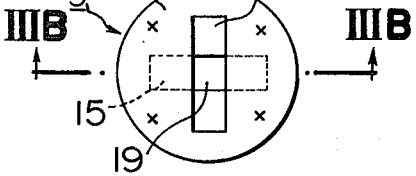
FIG. 3A PRIOR ART
Figure 3B:
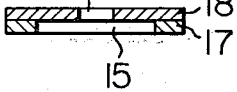
FIG. 3B PRIOR ART

With the intention of attaining a uniform focus characteristic over the whole phosphor screen, an electrode having a cross slit as shown in FIGS. 3A and 3B is used as the first grid electrode 9 of the electron gun. The diagrams of FIGS. 3A and 3B show the first grid electrode of one of a plurality of separate electron guns, which may alternatively be considered to be a part, corresponding to each electron beam, of the first grid electrode of an integrated electron gun. In an example of forming this first grid electrode 9, as shown in FIGS. 4A and 4B, two plates 17 and 18 having rectangular slits 15 and 16 are arranged in such a manner that the slits 15 and 16 cross each other at a right angle and these plates 17 and 18 are welded to each other at welding points marked with x in FIG. 3A, thus forming a beam passage aperture 18 at the central portion of the assemblage. In incorporating this first grid electrode, the plate 17 having the lateral slit 15 is arranged on the cathode side and the plate 18 having the vertical slit 16 on the second grid electrode side. In this first grid electrode, the thickness distribution of the plates 17 and 18 in the direction at which the electron beam passes is appropriately determined in accordance with the design of the color picture tube involved, in order to improve the focus characteristic.

The function of the cross slit of the first grid electrode 9 will be discussed below. Since the lateral slit 15 of the first grid electrode is arranged on the cathode side, the cross sectional view of the electron beam emitted from the cathode takes a lateral oval form due to the function of the lateral slit 15, and this lateral oval beam tends to be corrected by the function of the vertical slit 16. And due to an electric field distribution formed in dependence on the shape of the wall of the beam passage aperture 19 defined by the lateral slit 15 and the vertical slit 16, a lateral cross-over point of the electron beam that has passed the first grid electrode is formed at a position nearer to the cathode than a vertical cross-over point. In other words, the vertical cross-over point is formed at a position nearer to the phosphor screen than the lateral cross-over point. A general cross-over point for the whole of the electron beam (hereinafter referred to as the true cross-over point) is formed at a position between the lateral cross-over point and the vertical cross-over point. At this true cross-over point, the electron beam has a substantially circular section due to the space charge effect.

The distance over which the electron to beam travels toward the central part of the phosphor screen 2 is different from that toward the peripheral parts of the phosphor screen, and the latter is longer than the former. For this reason, a higher focus voltage is required for the peripheral parts than for the central part. Assuming that by use of the focus voltage for the central part, an image at the true cross-over point is obtained at the central part of the phosphor screen 2 to form a substantially circular beam spot, an image at a position displaced several hundred μm toward the phosphor screen 2 from the true cross-over point is obtained at the peripheral parts. In the case where an image at the true cross-over point is obtained on the phosphor screen, the electron beam when passing through the deflection coil 5 has a shape of a laterally oval section. Since the deflection magnetic field having a pincushion distortion and a barrel distortion acts to overfocus the electron beam in the vertical direction at the peripheral parts of the phosphor screen 2, resulting in producing a halo, an electron beam having the laterally oval sectional shape with a vertical axis shorter than that of an electron beam having a circular cross section generates a halo less than an electron beam having a circular cross section. In this case, the beam spot of the electron impinging on the phosphor screen 2 may be considered to have a greater lateral length than the longitudinal length. Such a greater lateral length, however, is prevented by the self-convergence function and the lateral length may substantially be the same as that of a beam spot attained by an electron beam with a circular cross section passing through the deflection coil 5. The shape of the beam spots at the central part and the peripheral parts of the fluorescent screen can be determined by appropriately determining the thicknesses of the plates 17 and 18, namely, the depths of the lateral slit 15 and the longitudinal slit 16 along the direction of the travel of the electron beam.

The above-mentioned function of the cross slit will be understood from the disclosure of "30AX SELF-ALIGNING 110° INLINE COLOR TV DISPLAY" presented by PHILIPS in No. 19 IEEE SPRING CONFERENCE (June, 1978). The functions and effect of a non-rotationally symmetrical aperture equivalent to the above-mentioned cross slit are disclosed, for example, in the British patent specification No. 1,421,865.

The first grid electrode 9 having such a cross slit, if made of the two plates 17 and 18 welded to each other, has disadvantages such that a high manufacturing cost is inevitable and the cut-off characteristic and the focus characteristic are deteriorated by a deformation due to welding and an assembly error. Especially, in the case of an integrated electron gun, it is difficult to weld the two plates 17 and 18 closely to each other, often resulting in a gap being formed between the two plates. This causes a condition similar to a change in the thickness of the slit plates, thus greatly deteriorating the cut-off and focus characteristics.

Figure 5A:
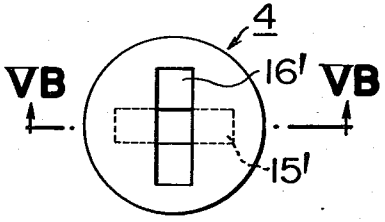
Figure 5B:
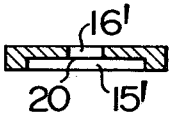

In order to eliminate the disadvantages caused by the welding of the two plates 17 and 18, the present invention have conducted various researches and experiments on the shape of the first grid electrode comprising a single plate and the production thereof. It is theoretically possible but practically difficult and not suitable for mass-production to fabricate an electrode of the shape shown in FIGS. 3A and 3B by integrally press-forming a single plate as shown in FIGS. 5A and 5B. Specifically, in coining the form shown in FIGS. 5A and 5B by pressing, the upper surface of a lower die jig having a shape of the lateral slit 15' collides with the lower surface of an upper die jig having a shape of the vertical slit 16' at the slit bottom 20, and the resulting shock breaks the jigs. Further, it is actually impossible to cause the lower and upper surfaces of the upper and lower die jigs to completely coincide with each other at the slit bottom 20.

The present invention has been developed in view of the above-mentioned background and an object thereof is to provide a construction of an electrode, having a cross slit, of a color picture tube electron gun which can be mass-produced, and to provide a method for producing such an electrode.

According to one aspect of the present invention, there is provided an electrode of a color picture tube electron gun, having an aperture for passing an electron beam, the electrode comprising a first recess having a predetermined width and depth formed in a first surface of a single metal plate and extending in a predetermined direction substantially symmetrically with respect to the axis of the electron beam pass aperture, and a second recess having a predetermined width and depth formed in a second surface opposite to the first surface and extending in a direction substantially perpendicular to the predetermined direction substantially symmetrically with respect to the axis of the beam pass aperture.

According to another aspect of the invention, there is provided an electrode of a color picture tube electron gun, having a plurality of electron beam pass apertures in alignment, the electrode comprising a plurality of first recesses each having a predetermined width and depth and formed in a first surface of a single metal plate, the first recesses extending in a predetermined direction substantially symmetrically with respect to the axis of the corresponding one of the electron beam pass apertures, and a plurality of second recesses each having a predetermined width and depth and formed in a second surface opposite to the first surface of the metal plate, the second recesses extending in a direction substantially perpendicular to the predetermined direction substantially symmetrically with respect to the axis of the corresponding one of the beam pass apertures.

According to still another aspect of the invention, there is provided, in an electron gun of a color picture tube, having a plurality of cathodes aligned in a predetermined direction substantially parallel to a phosphor screen of the color picture tube for emitting electrons and a plurality of electrodes arranged in a direction substantially perpendicular to the phosphor screen, the electrode arranged nearest to the cathodes and having a plurality of electron beam pass apertures aligned in the predetermined direction and in correspondence with the cathodes, the electrode comprising a plurality of first recesses each having a predetermined width and depth and formed in a first surface of a single metal plate facing the cathodes and extending in a predetermined direction substantially symmetrically with respect to an axis of the corresponding one of the electron beam pass apertures, and a plurality of second recesses each having a predetermined width and depth and formed in a second surface opposite to the first surface of the metal plate and extending in a direction substantially perpendicular to the predetermined direction and parallel to the phosphor screen substantially symmetrically with respect to an axis of the corresponding one of the electron beam pass apertures.

According to a further aspect of the invention, there is provided a method for producing the above-mentioned electrode, comprising the steps of interposing the metal plate between a first die of the same shape as the first recess and a second die of the same shape as the second recess arranged with an axis thereof on the axis of the first die, coining the first surface and the second surface with a predetermined gap between the first die and the second die by pressing the first die on the first surface and the second die on the second surface simultaneously, and forming a through hole of a predetermined shape at a portion where the first recess and the second recess are overlaid one on the other as viewed in the direction perpendicular to the surface of the metal plate.

Figure 6A:
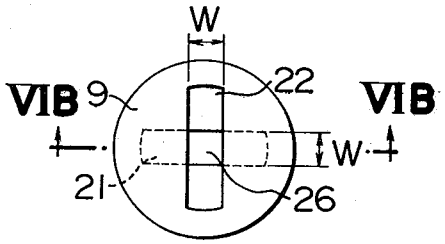
Figure 6B:
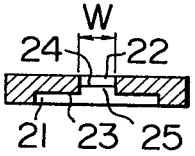

An embodiment of the present inventon will be described below with reference to the accompanying drawings. A first embodiment of the first grid electrode 9 according to the present invention is shown in FIGS. 6A and 6B. This first grid electrode 9 has one surface formed with a substantially rectangular recess 21 of a predetermined width and depth extending in the lateral direction and the other surface formed with a substantially rectangular recess 22 of a predetermined width and depth extending in the vertical direction. The recesses 21 and 22 are formed by being coined with a predetermined gap 25 between the bottoms 23 and 24 thereof. A substantially square electron beam pass aperture 26, which has four sides each almost equal to or slightly smaller than the width of the lateral recess 21, is formed at a position where the recesses 21 and 22 are overlapped one on the other in a plan view of the electrode 9. The recesses 21 and 22 are respectively substantially symmetric with respect to the center axis of the electron beam pass aperture 26. For convenience sake, the shape obtained from the recesses 21 and 22 and the aperture 26 will also be referred to as a cross slit. In this embodiment, the recesses 21 and 22 have substantially the same width W. This electrode 9 is arranged in the electron gun 3 in such a manner that the surface thereof having the lateral recess 21 faces the cathode 6.

By constructing the electrode 9 in such a manner as to have a cross slit of the above-mentioned shape, it is possible to form the recesses 21 and 22 with the gap 25 therebetween, with the result that the upper die jig and the lower die jig are prevented from being broken by collision during the coining process, thus facilitating mass production of the electrode 9. After forming the recesses 21 and 22 by coining, the beam pass aperture 26 is formed by punching on a press thus producing the electrode 9.

Figure 7A:
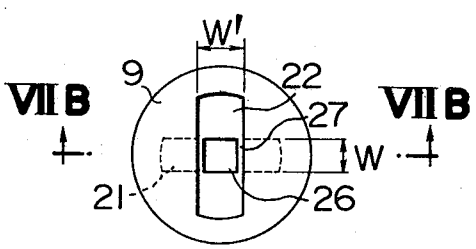
Figure 7B:
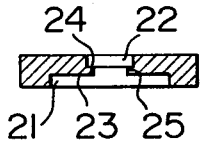

A second embodiment of the first grid electrode 9 according to the present invention is shown in FIGS. 7A and 7B. Also in this embodiment, the lateral recess 21 and the vertical recess 22 are formed with a predetermined gap 25 therebetween. The embodiment under consideration is different from the embodiment of FIGS. 6A and 6B in that in this embodiment the vertical recess 22 (or the lateral recess 21) has a larger width W' than the lateral recess 21 (or the vertical recess 22) whose width is W. Each side of the electron beam pass aperture 26 is substantially equal to or slightly shorter than the width W. In this cross slit construction, when the electron beam pass aperture 26 is formed, the portion 26 to be punched off and a portion 27 which is left unpunched can be supported in the same plane on the upper surface of the lower die jig by inserting the lower die jig in the recess of the comparatively large width W', thereby improving the punching accuracy.

A third embodiment of the first grid electrode according to the present invention is shown in FIGS. 8A and 8B. In this embodiment, as in the embodiment of FIGS. 7A and 7B, the lateral recess 21 having the comparatively narrow width W and the vertical recess 22 having the comparatively large width W' are formed with the predetermined gap 25 therebetween. This embodiment is different from the embodiment of FIGS. 7A and 7B in that in this embodiment the side walls of the recesses 21 and 22 are tapered at a predetermined angle $\theta$. By so doing, the outer peripheral edge of the top of the coining die is prevented from being broken or otherwise damaged, thus improving the service life of the die. Although this embodiment has been described by reference to tapering the recesses 21 and 22 of the embodiment shown in FIGS. 7A and 7B, the recesses 21 and 22 of the embodiment of FIGS. 6A and 6B may similarly be tapered. If desired from the viewpoint of the electrical characteristics, only a selected one of the recesses 21 and 22 may be provided with such a tapering.

The inventors have studied how the shape of the first grid electrode 9, namely, the width, depth and taper angle of the lateral recess 21 and the vertical recess 22 and the gap 25 between the recesses 21 and 22 affect the focus characteristic (or beam spot shape) or the cut-off voltage. As a result, it has been found that, by increasing the depth of the lateral recess 21 facing the cathode, the cross section of the electron beam becomes more laterally oval and, by increasing the depth of the vertical recess 22 on the second grid side, the cross section of the electron beam becomes more vertically oval, thereby accordingly changing the shape of the beam spot or the area of the halo on the phosphor screen 2. It has also been found that in this case the depth of the lateral recess 21 largely affects the area of the halo. Further, it has been discovered that the depth and width of the lateral recess 21 greatly affect the cut-off characteristic and therefore are limited by the desired cut-off characteristic of the picture tube involved, while the depth and width of the vertical recess 22 has a margin in design. If the width of the vertical recess 22 is reduced, for instance, the change in the effect on the characteristic can be regulated by reducing the depth appropriately. It has also been found that even when the gap 25 is formed between the lateral recess 21 and the vertical recess 22, the sectional shape of the electron beam at positions before and after the true cross-over point may be changed according to the depth of the vertical recess 22. Furthermore, the focus characteristic and cut-off characteristic are changed as a result of tapering the side wall of the recesses, but such a change can be suppressed by increasing the depth of the recesses in the case where the tapering increases the effective width of the recesses, or by reducing the depth of the recesses in the case where the tapering decreases the effective width of the recesses.

Thus, the shape of the cross slit is determined according to the degree of improvement in the cut-off characteristic and focus characteristic, required for each color picture tube involved. In other words, by properly designing the shape of the cross slit, the cut-off characteristic and the focus characteristic are improved to the required degree. An experiment has been effected, as an example, on the embodiment of FIGS. 8A and 8B, provided with the lateral recess 21 having the width of 0.7 mm and the length of 2 mm at the bottom thereof, the depth of 0.08 mm,, and the side wall tapering of 5/11; the vertical recess 22 having the width of 1 mm and the length of 2 mm at the bottom thereof, the depth of 0.11 mm, and the side wall tapering of 5/11; and the electron beam pass aperture 26 square in shape having the sides each 0.67 mm long. The results of the experiment showed the cut-off characteristic and focus characteristic satisfactory for the practical purposes.

Figure 9A:
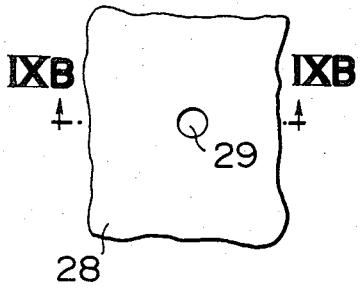
Figure 9B:
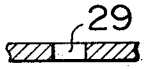
Figure 9C:
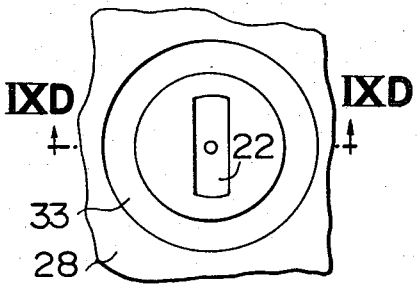
Figure 9D:
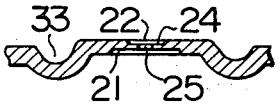
Figure 9E:
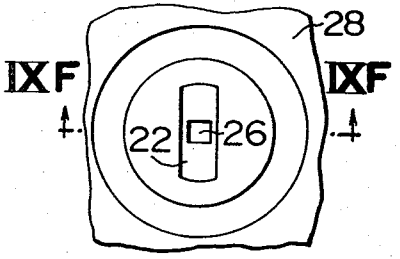
Figure 9F:
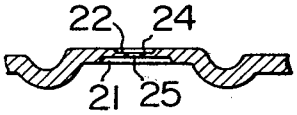
Figure 10A:
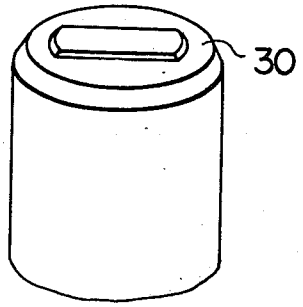
FIGS. 10A and 10B are perspective views of dies used for forming the cross slits in the fabrication of the electrode of FIGS. 8A and 8B.
Figure 10B:
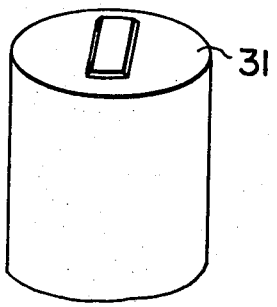

An example of a method for fabricating the electrode 9 of FIGS. 8A and 8B will be described with reference to FIGS. 9A to 9F. As shown in FIGS. 9A and 9B, a metal plate member 28 having the thickness of about 0.33 mm is punched with a hole 29 of about 0.6 mm diameter. Next, as shown in FIGS. 9C and 9D, the lateral recess 21 and the vertical recess 22 are formed simultaneousl by a coining process with the gap 25, by means of the upper die jig 30 having a shape similar to the lateral recess 21 as shown in FIG. 10A and the lower die jig 31 having a shape similar to the vertical recess 22 as shown in FIG. 10B. In the process, a circular groove 33 is formed around the recesses 21 and 22 as shown in the drawings, which groove is not related to the present invention and therefore will not be described any further. While supporting the bottom 24 of the comparatively wide vertical recess 22 on the top flat surface 35 of the lower die jig 34 for punching the beam pass aperture shown in FIG. 11, the beam pass aperture 26 is punched as shown in FIGS. 9E and 9F by means of an upper die jig (not shown) having the same size as the beam pass aperture 26 through the lateral recess 21. At the last step, the metal plate member is punched to the desired outer dimension thereby to obtain the electrode 9. The change in the thickness of the metal plate member 28 which occurs during the coining is absorbed by the hole 29. The coining work is of course performed with the center axis of the lower die jig 30 and the upper die jig 31 aligned with each other.

An example of the first grid electrode for an integrated electron gun of in-line type fabricated in this way is shown in FIGS. 12A and 12B.

Instead of a substantially square beam pass aperture 26 shown in the above-mentioned embodiments, a circular beam pass aperture may be formed. A circular beam pass aperture will affect the focus characteristic and the cut-off characteristic differently from the square beam pass aperture, and therefore this fact must be taken into consideration in determining the width and depth of the recesses 21 and 22. Also, in the above-mentioned embodiments, the recesses 21 and 22 are substantially rectangular in plan view, which may of course be replaced by any other shape which has an equal effect as the rectangular shape.

It will be understood from the foregoing description that, according to the present invention, the first grid electrode having the cross slit can be integrally formed of a single part, so that the number of parts is reduced and the need of the assembly work by welding is eliminated thereby to make its mass-production possible, thus reducing the production cost. Further, deterioration of the characteristics which might occur if two plates are overlaid one on the other, deformation by welding or reduction in accuracy can be obviated, thereby making it possible to produce an electrode which is superior in characteristics and uniform in quality. What is claimed is:

1. An electrode of a color picture tube electron gun, having an aperture for passing an electron beam, said electrode comprising a first recess having a predetermined width and depth formed in a first surface of a single metal plate and having a predetermined length extending in a first predetermined direction substantially symmetrically with respect to an axis of said electron beam pass aperture, a second recess having a predetermined width and depth formed in said same single metal plate in a second surface opposite to said first surface and having a predetermined length extending in a second direction substantially perpendicular to said first predetermined direction substantially symmetrically with respect to the axis of said beam pass aperture, and a predetermined gap between the bottoms of said first recess and said second recess, said gap extending in the parallel direction with said surfaces of the metal plate only within an area defined by said electron beam pass aperture.

2. A method for producing an electrode of a color picture tube electron gun according to claim 1, comprising the steps of interposing said metal plate between a first die of the same shape as said first recess and a second die of the same shape as said second recess arranged with an axis thereof on the axis of said first die, coining said first surface and said second surface with a predetermined gap between said first die and said second die by pressing said first die on said first surface and said second die on said second surface simultaneously, and forming a through hole of a predetermined shape at a portion where said first recess and said second recess are overlaid one on the other as viewed in the direction perpendicular to the surface of said metal plate.

3. An electrode according to claim 1, wherein at least one of said first recess and said second recess has a side wall which is tapered.

4. An electrode of a color picture tube electron gun, having a plurality of electron beam pass apertures in alignment, said electrode comprising a plurality of first recesses each having a predetermined width and depth and formed in a first surface of a single metal plate, each of said first recesses having a predetermined length extending in a predetermined direction substantially symmetrically with respect to an axis of a corresponding one of said electron beam pass apertures, a plurality of second recesses each having a predetermined width and depth and formed in a second surface opposite to said first surface of said single metal plate, each of said second recesses having a predetermined length extending in a direction substantially perpendicular to said predetermined direction substantially symmetrically with respect to an axis of a corresponding one of said beam apertures, and a plurality of predetermined gaps between bottoms of said first recesses and said second recesses, respectively, each of said gaps extending in the parallel direction with said surfaces of the metal plate only within an area defined by a corresponding one of said electron beam pass apertures.

5. An electrode according to claim 4, wherein at least one of said first recess and said second recess has a side wall which is tapered.

6. In an electron gun of a color picture tube, having a plurality of cathodes aligned in a predetermined direction substantially parallel to a phosphor screen of said color picture tube for emitting electrons and a plurality of electrodes arranged in a direction substantially perpendicular to the phosphor screen, the electrode arranged nearest to said cathodes and having a plurality of electron beam pass apertures aligned in said predetermined direction and in correspondence with said cathodes, said electrode comprising a plurality of first recesses each having a predetermined width and depth and formed in a first surface of a single metal plate facing said cathodes, each of said first recesses having a length extending in a predetermined direction substantially symmetrically with respect to an axis of a corresponding one of said electron beam pass apertures, a plurality of second recesses each having a predetermined width and depth and formed in a second surface opposite to said first surface of said single metal plate, each of said first recesses having a length extending in a direction substantially perpendicular to said predetermined extending direction of the length of the first recess substantially symmetrically with respect to an axis of a corresponding one of said electron beam pass apertures, and a plurality of predetermined gaps between bottoms of said first recesses and said second recesses, respectively, each of said gaps extending in the parallel direction with said surfaces of the metal plate only within an area defined by a corresponding one of said electron beam pass apertures.

7. An electrode according to claim 6, wherein at least one of said first recess and said second recess has a side wall which is tapered.

8. An electrode according to claim 1, 3, 4, 5, 6 or 7, wherein the width of said first recess is greater than the width of said second recess.

* * * * *